US010010804B1

(12) United States Patent
Jung

(10) Patent No.: US 10,010,804 B1
(45) Date of Patent: Jul. 3, 2018

(54) ADJUSTABLE SAND MOLDING TOY

(71) Applicant: Kurt Jung, Pompton Plains, NJ (US)

(72) Inventor: Kurt Jung, Pompton Plains, NJ (US)

( * ) Notice: Subject to any disclaimer, the term of this patent is extended or adjusted under 35 U.S.C. 154(b) by 0 days.

(21) Appl. No.: 15/384,659

(22) Filed: Dec. 20, 2016

Related U.S. Application Data

(60) Provisional application No. 62/270,726, filed on Dec. 22, 2015.

(51) Int. Cl.
*A63H 33/32* (2006.01)
*A63H 33/00* (2006.01)

(52) U.S. Cl.
CPC ..... *A63H 33/32* (2013.01); *A63H 33/001* (2013.01)

(58) Field of Classification Search
CPC ..... A63H 33/00; A63H 33/32; A63H 33/001
See application file for complete search history.

(56) References Cited

U.S. PATENT DOCUMENTS 1,610,121 A * 12/1926 Dickinson ..... A63H 33/001 249/142
1,639,934 A * 8/1927 Ferring ..... A63H 33/001 249/165
1,886,486 A * 11/1932 Le Ganger ..... A63H 33/001 249/104
4,887,789 A * 12/1989 Harris ..... E04G 9/10 249/134
6,126,876 A 10/2000 Demarzo
6,149,485 A 11/2000 Christiansen
8,857,783 B2 * 10/2014 Thorpe-Doubble .. B29C 39/003 249/101
D788,856 S * 6/2017 Jung ..... D21/472
D810,205 S * 2/2018 Jung ..... D21/472
2004/0227053 A1 * 11/2004 Manthei ..... B28B 7/0044 249/83
2008/0251687 A1 * 10/2008 Taufield ..... A63H 33/32 249/61
2013/0069265 A1 3/2013 Djoboulian

FOREIGN PATENT DOCUMENTS

WO WO0149387 7/2001
WO WO2008100619 8/2008
WO WO2013040700 3/2013

* cited by examiner

*Primary Examiner* — Gene Kim
*Assistant Examiner* — Alyssa Hylinski
(74) *Attorney, Agent, or Firm* — Goldstein Law Offices, P.C.

(57) ABSTRACT

An adjustable sand molding toy, including at least one sand mold. The sand mold including a plurality of panels and a main belt. The panels each have a panel length, an inside surface, an outside surface, a pair of lateral sides, and connecting brackets at the lateral sides. Each lateral side has at least one tab and at least one tab opening. The panels can be selected in a quantity and with panel lengths to make a desired shape. The belt is extended through the connecting brackets on the panels thus selected and tightened to hold the panels tightly together with the lateral sides of adjacent panels abutting each other, and the tabs extending into the tab opening of adjacent panels, to form the desired shape. The sand mold is filled with wet sand, and the sand mold is released from the sand to reveal a shaped sand mound.

13 Claims, 13 Drawing Sheets

ADJUSTABLE SAND MOLDING TOY

CROSS-REFERENCE TO RELATED APPLICATIONS

This application is a nonprovisional utility application of provisional patent application Ser. No. 62/270,726, filed in the United States Patent Office on Dec. 22, 2015, claims priority therefrom, and is expressly incorporated herein by reference in its entirety.

TECHNICAL FIELD

The present disclosure relates generally to an adjustable sand molding toy. More particularly, the present disclosure relates to a molding toy having connected panels that can be used to cast a variety of shapes using wet sand.

BACKGROUND

Playing in the sand with shovels and pails is an age-old pastime for beach fun! Inevitably digging in the sand leads to filling pails with sand, and filling pails leads to casting pail-shaped mounds of sand on the beach. These pail shaped mounds can be the beginning of a sand castle, or any other structure imagined.

When building on the beach, one is limited to the shape of the pail they have on hand. As a result, most sand structures resemble the upside down pail from whence they came.

Further, younger children often have a hard time mixing the proper combination of sand and water in order to create a shaped sand mound that both can be cleanly released from the bucket, and will hold its shape without immediately collapsing.

What is needed is a system that facilitates the creation of a sand castle that not only resembles a castle, but is easy to create without frustration or failure. Sometimes rigid plastic molds are provided that foster additional, even "castle-like" shapes for building. Generally, however, these molds are limited in that they can only provide a sculpted mound of sand that is of a single size and of a single predetermined shape.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a system for easily and reliably creating a sand structure. Accordingly, the present disclosure provides at least one sand mold that is open both on its top and bottom, such that it can be positioned in place and subsequently filled with sand and water in an ideal mixture and suitably packed, such that once the mold is removed a sand mound, formed in a desired shape, is revealed.

It is another aspect of an example embodiment in the present disclosure to provide a sand mold that is adjustable to various desired shapes. Accordingly, the sand mold includes a plurality of panels and a main belt. The panels employed in the sand mold can be selected to be of desired sizes and in a desired quantity, the main belt holding the panels thus selected tightly together into a desired shape.

It is yet a further aspect of an example embodiment in the present disclosure to provide a sand molding toy that allows complex shapes to be easily created. Accordingly the sand molding toy may include several sand molds, each may include panels of various sizes, such that the sand molds can be stacked to create innumerable variations of sand structures.

Accordingly, the present disclosure describes an adjustable sand molding toy, including at least one sand mold. The sand mold including a plurality of panels and a main belt. The panels each have a panel length, an inside surface, an outside surface, a pair of lateral sides, and connecting brackets at the lateral sides. Each lateral side has at least one tab and at least one tab opening. The panels can be selected in a quantity and with panel lengths to make a desired shape. The belt is extended through the connecting brackets on the panels thus selected and tightened to hold the panels tightly together with the lateral sides of adjacent panels abutting each other, and the tabs extending into the tab opening of adjacent panels, to form the desired shape. The sand mold is then filled with sand and an ideal sand and water mixture is created within the shape, and the sand mold is released from the sand to reveal a shaped sand mound in the desired shape.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
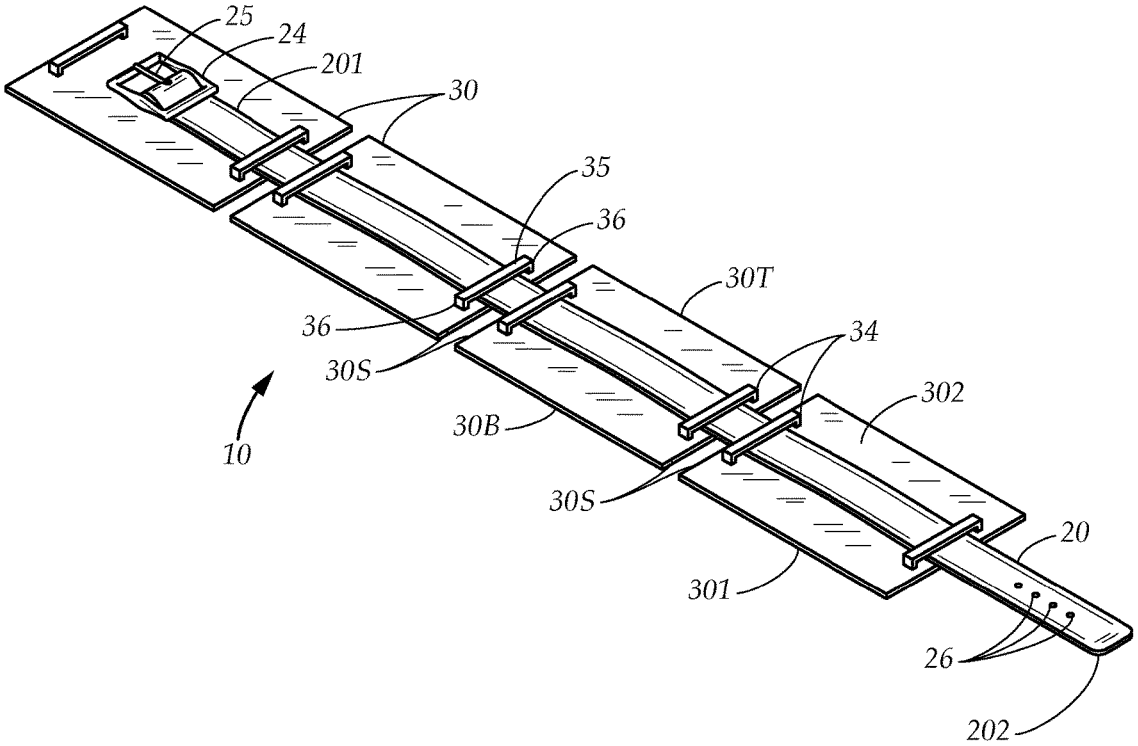
FIG. 1 is a diagrammatic perspective view, illustrating an adjustable sand molding toy in its fully open position, laid flat.

FIG. 1 illustrates an adjustable sand mold 10, which represents a core unit of an adjustable sand molding toy in accordance with the present disclosure. The adjustable sand mold 10 has a main belt 20 and a plurality of panels 30. Each panel 30 has a top edge 30T, a bottom edge 30B, and a pair of lateral sides 30S. Each panel 30 has a panel length between the lateral sides 30S and a panel height between the bottom edge 30B and top edge 30T. Each panel 30 also has an inside surface 301, and an outside surface 302. Each panel 30 has a pair of connecting brackets 34. The connecting brackets 34 each have a main leg 35 that extends substantially parallel to the outside surface 302, and a pair of short legs 36 that join the main leg 35 to the outside surface 302. Each of the connecting brackets 34 extends generally near and parallel to one of the lateral sides 30S, and typically perpendicular to the top edge 30T and bottom edge 30B.

The main belt 20 has a first end 201 and a second end 202. The main belt 20 has a fastening mechanism for selectively joining the belt 20 into a closed loop in a secured position, wherein the first end 201 is attached near the second end 202. As an example of the fastening mechanism, the belt 20 may have a buckle 24 having a tongue 25 at the first end 201 and a plurality of spaced holes 26 near the second end 202. The tongue 25 is selectively placed within one of the spaced holes 26 to fix the main belt 20 in the secured position. Note that in addition to the example illustrated, other mechanisms can be employed as the fastening mechanism. For example, the buckle 24 as illustrated may be replaced with a cam buckle that employs friction to tighten against the belt 24 at any point along the belt. In addition, it would allow the belt to be made as tight or as loose as desired—with fine adjustment possible—to enhance the adjustability of the mold 10. Accordingly, with the use of a cam buckle, the spaced holes 26 would be unnecessary, and would allow greater variation in the length of the belt employed and thus a greater variation in available configurations.

Figure 2:
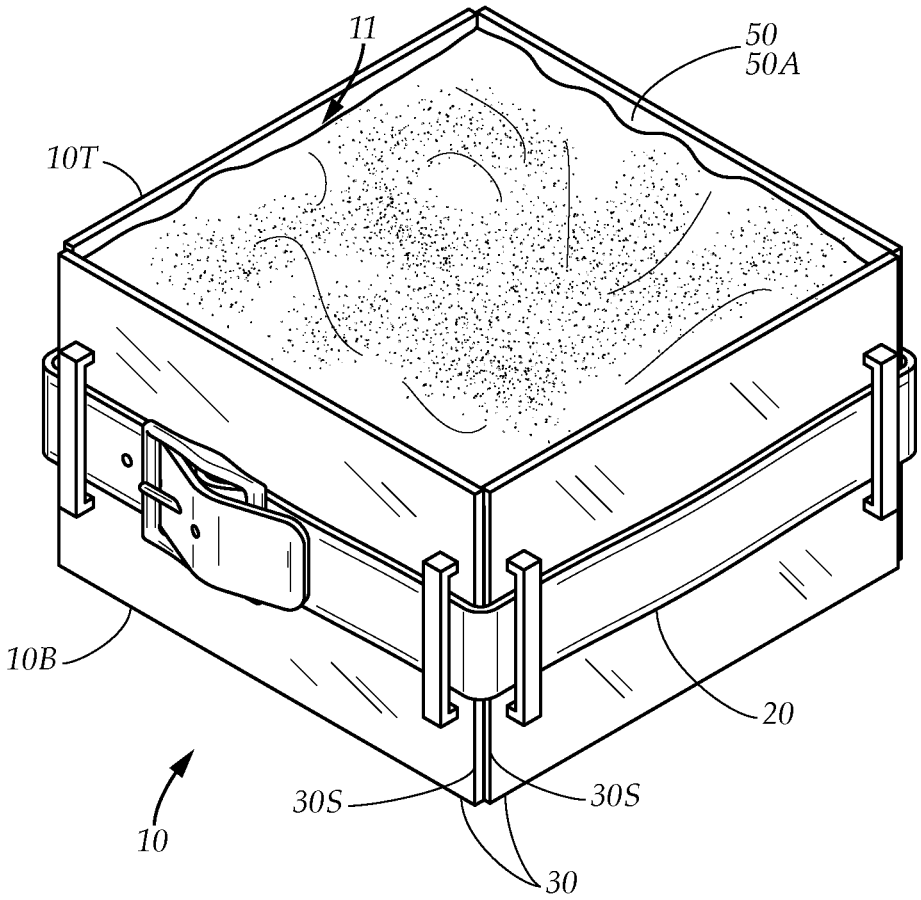
FIG. 2 is a diagrammatic perspective view, illustrating an exemplative sand mold in its closed position, formed in the shape of a square prism, holding a quantity of wet sand therewithin.
Figure 3:
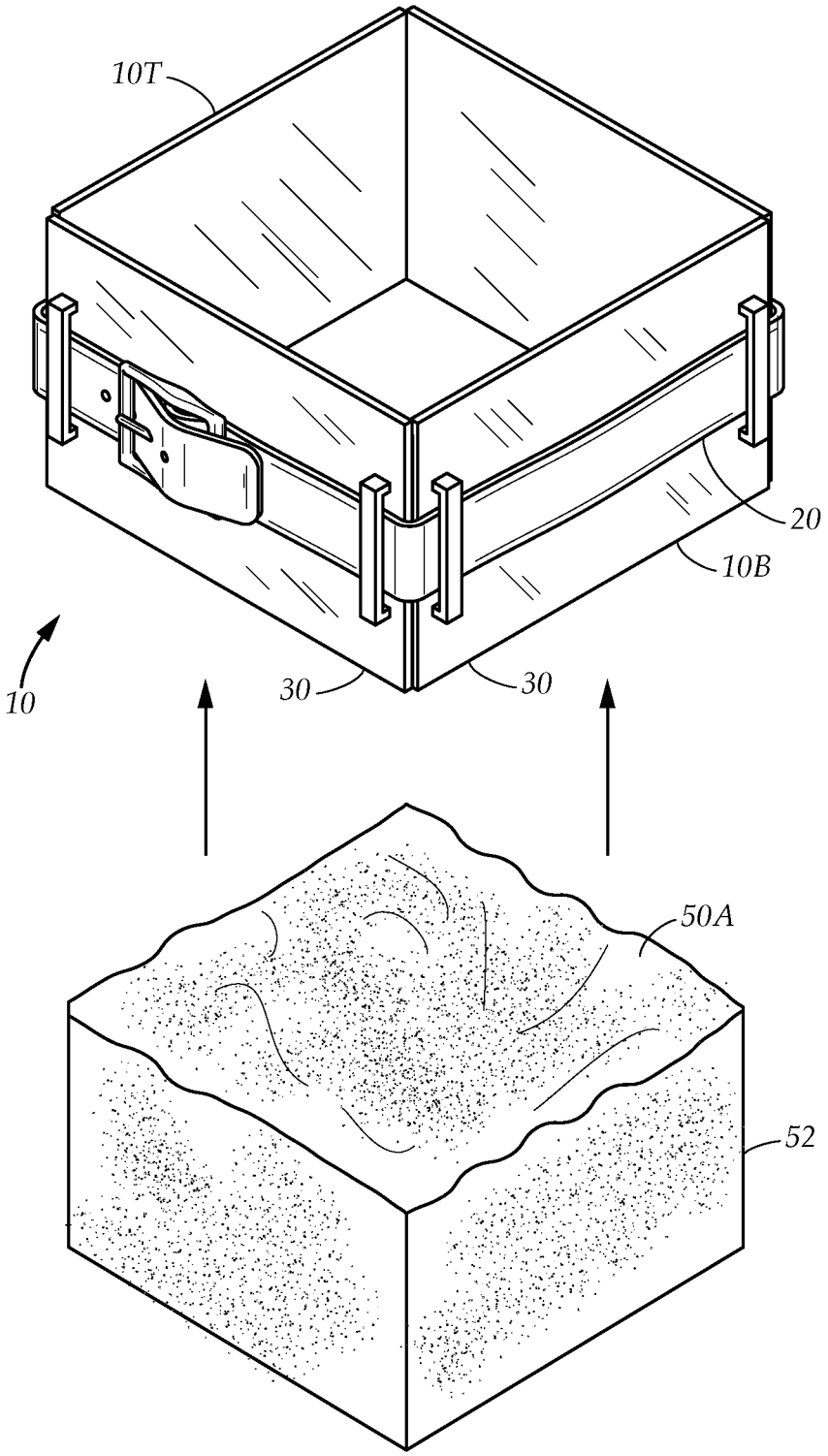
FIG. 3 is a diagrammatic perspective view, similar to FIG. 2, except wherein the sand mold is being lifted to reveal a cast sand mound in the current square prism shape of the sand molding toy.
Figure 5A:
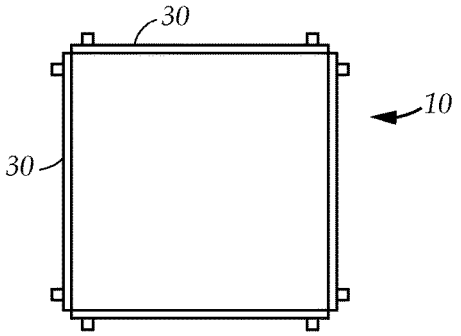
FIG. 5A is a top plan view, showing the sand mold, wherein four panels are used to create a square prism.
Figure 5B:
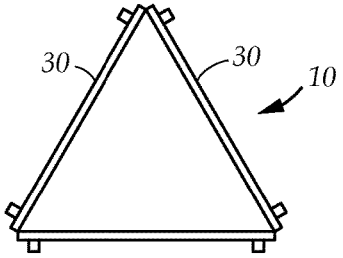
FIG. 5B is a top plan view, showing the sand mold, wherein three panels are used to create a triangular prism.
Figure 5C:
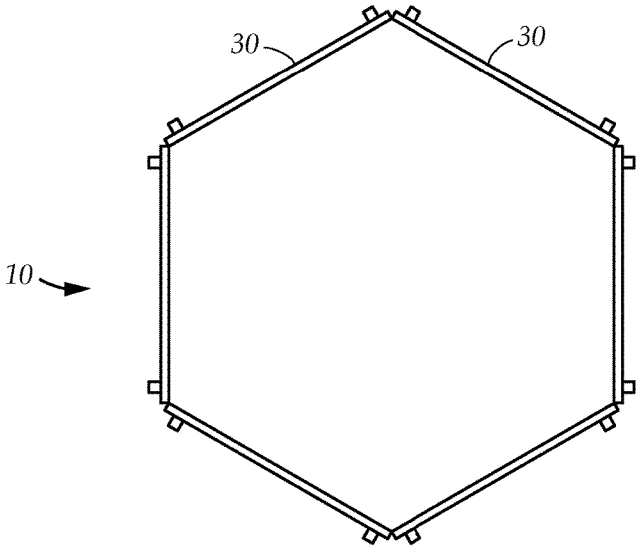
FIG. 5C is a top plan view, showing the sand mold, wherein six panels are used to create a hexagonal prism.

Referring to FIG. 2, the main belt 20 is shown in its secured position, wherein the panels 30 closely abut each other, with their lateral sides 30S held tightly against each other. The main belt 20 extends through the connecting brackets 34, maintaining the belt 20 tightly against the panels 30, as the belt has been tightened to hold the lateral sides 30S of the panels close together. The sand mold 10 has a perimeter that is formed by the panels 30, and is formed into a desired shape—defining an interior cavity 11 that has that desired shape that includes a footprint that is defined by the perimeter. Note that the sand mold 10 has a top 10T and a bottom 10B. Best seen in FIG. 3, the mold 10 is open at its top 10T and bottom 10B. Referring to FIGS. 5A, 5B, and 5C, the panels 30 can be used to form different shapes with the sand mold 10 by varying the number of panels used. With three panels 30, a triangular prism is formed (as in FIG. 5B). With four panels 30, a square or rectangular prism is formed (as in FIG. 5A). With six panels 30, a hexagonal prism is formed (as in FIG. 5C). While for the versions shown, each of the panels have the same panel length, for any given number of panels employed the panels can have differing panel lengths positioned in different sequences around the perimeter, providing numerous additional variations in shapes and configurations. In addition to regular polygons, irregular polygons can be created—even when panels are employed that have the same panel length. The main belt 20 serves as a hinge between panels that allows a user to adjust the angles between panels 30 within reason, thus allowing a wide variety of shapes to be created—even with the same configuration of panels 30. Preferably, however, all panels 30 have the same panel height. Note that multiple belts 20 can be connected together, to allow even more panels to be joined together. In addition, different length belts can be employed for the convenience of typical and desirable configurations of the mold 10.

Referring again to FIG. 1, the belt 20 essentially strings the panels together, such that the tightening of the belt forms a polygonal prism with the panels 30 creating the perimeter thereof. The belt 20, however, can be removed from the panels 30 and individual panels 30 can be added to or removed from the belt 20 to create different configurations, such as those shown in FIGS. 5A, 5B, and 5C. Generally, once the desired assortment of panels 30 are placed side by side with their lateral sides 30S nearly touching, the belt 20 is threaded through the connecting brackets 34 to string them together. Alternatively, the first end 201 may remain permanently or semi-permanently attached to one of the panels 30—preferably centered between the connecting brackets 34 thereon. In that case, the panels 30 may be conveniently added until the panels necessary to form the desired shape are present.

Figure 6:
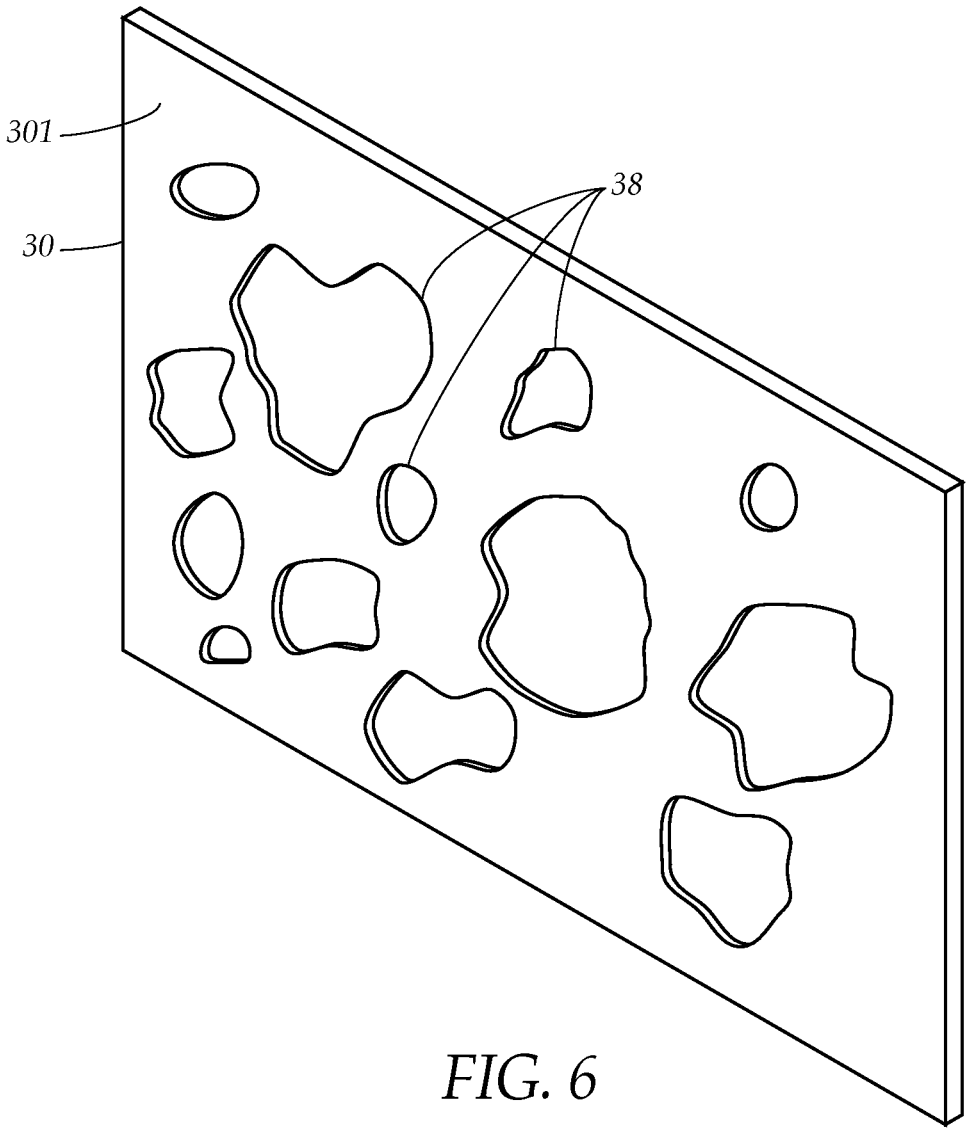
FIG. 6 is a diagrammatic perspective view, showing an embodiment of one of the panels, having an inside textured surface.

Referring again to FIG. 2, once the belt 20 is tightened and secured, and the sand mold 10 is in the desired shape, the panels 30 together define the interior cavity 11 between the inside surfaces 301 of the panels 30. The interior cavity 11 is in the shape of a polygon with the inside surfaces 301 of the panels 30 facing each other and the lateral sides 30S of adjacent panels 30 abutting each other. The mold 10 is placed on a ground surface with the bottom edge of the panels upon said ground surface and the interior cavity 11 is filled with sand 50 from the top edge. Note that water may be introduced (and sand added and packed), until the desired consistency/mixture of wet sand 50A densely fills all corners and cavities of the mold 10, and the wet sand 50A is leveled within the mold 10 as desired. Then, referring to FIG. 3, the mold 10 can be lifted up off of the sand 50, revealing a sand mound 52 in the shape of the interior cavity 11 as defined by the shape of the mold 10 (as defined by the panels that form the perimeter thereof). Alternatively, to release the sand mound 52 from the mold 10, the belt 20 can be loosened and the panels 30 moved outwardly to free them from the wet sand 50A. This is especially a preferred manner of freeing the mold 10 from the sand mound 52 when the panels are textured. In particular, referring to FIG. 6, the inside surface 301 of one, some, or all of the panels may have a textured pattern 38 thereon. The textured pattern 38 can be configured to create impressions in any desired pattern. For example, as illustrated in FIG. 6, the textured pattern can be configured to create impressions in the sand that simulate stone, such as would be found in the stone wall of a castle.

Figure 4A:
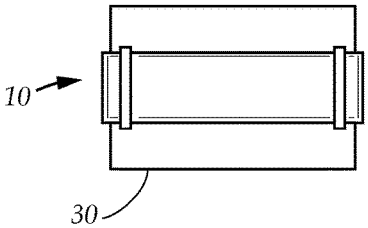
FIGS. 4A, 4B, and 4C illustrate the sand molding toy, including sand molds provided in multiple sizes, and in various quantities.
Figure 4B:
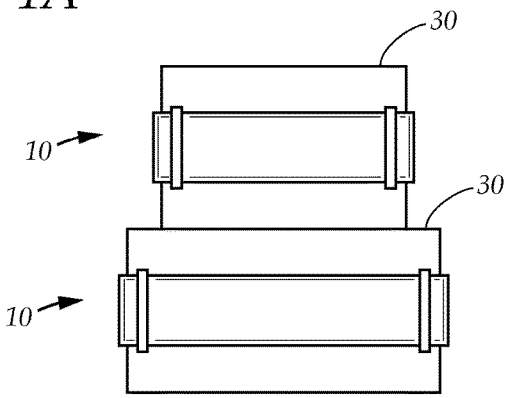
Figure 4C:
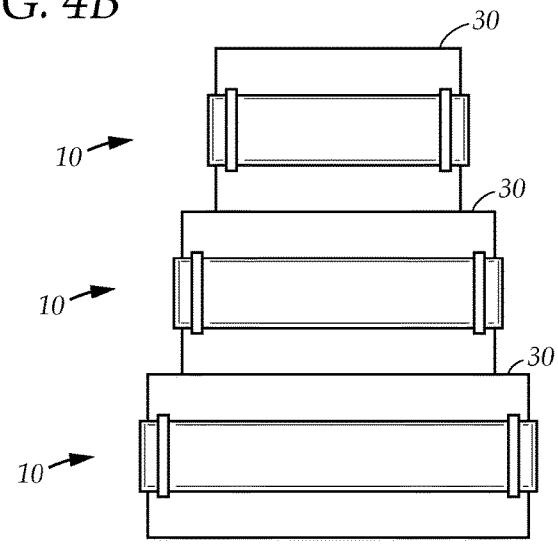

Referring to FIGS. 4A, 4B, and 4C, the sand mold 10 may be provided in different sizes—namely with panels 30 having different panel lengths. Different sized panels 30 may be provided in a kit, each panel 30 color-coded according to their panel length. In addition, the adjustable sand molding toy may include multiple sand molds 10, which can be configured to create different sized molds 10, that can be stacked to create complex, tiered structures, such as a tiered sand castle, or used creatively in any imaginable way to create other structures.

Figure 7:
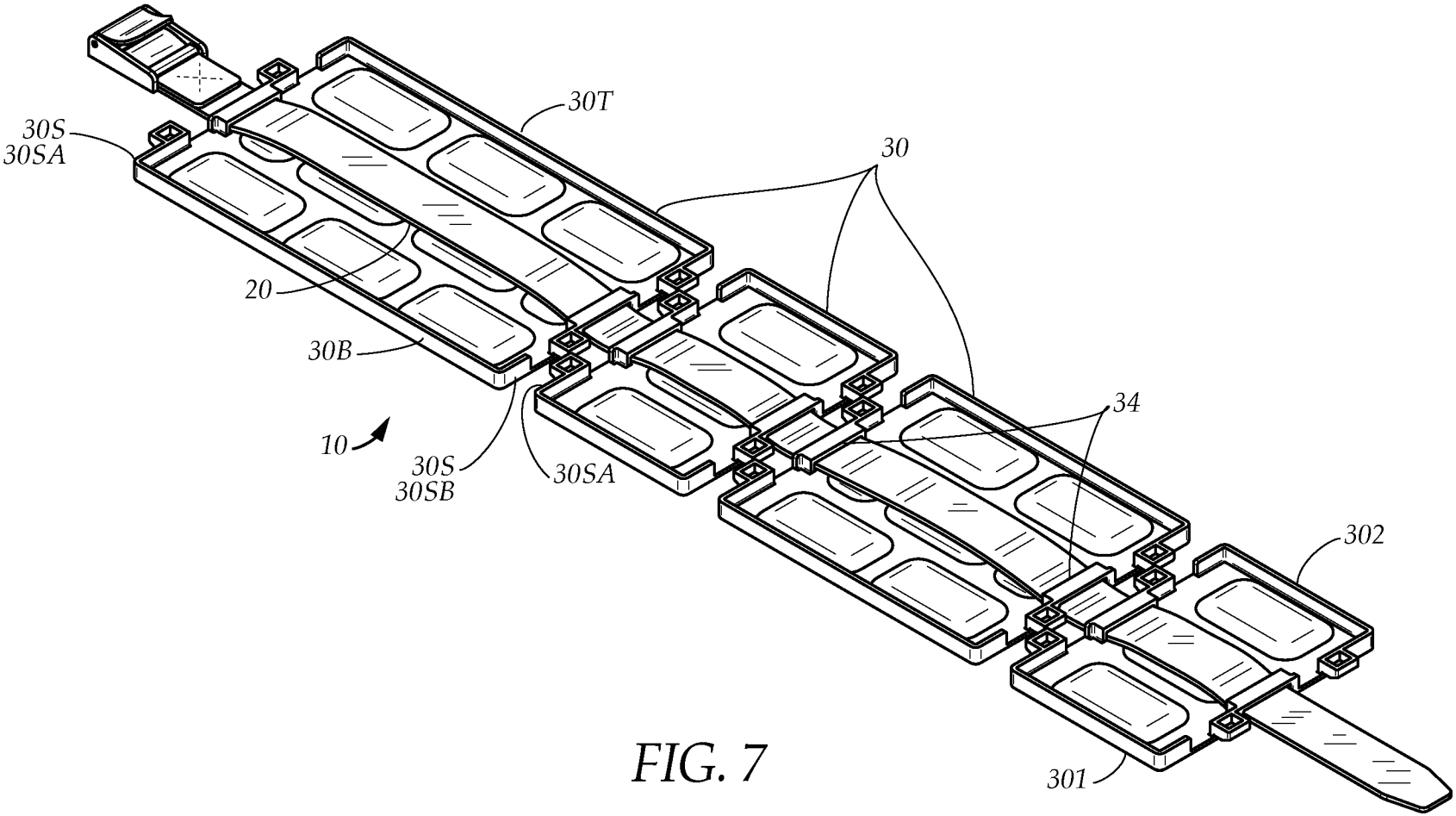
FIG. 7 is a diagrammatic perspective view, illustrating a second embodiment of the adjustable sand molding toy in its fully open position, laid flat.
Figure 8A:
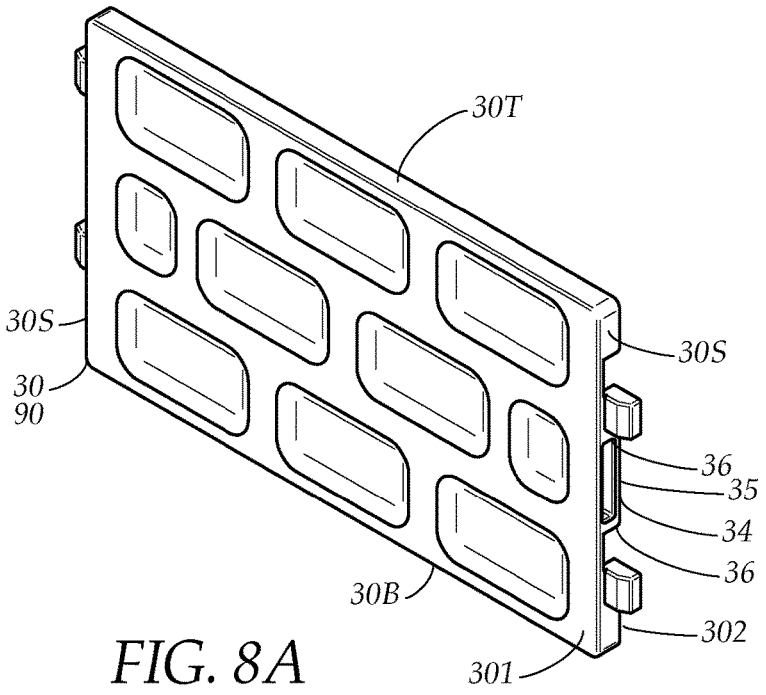
FIG. 8A is a diagrammatic perspective view, illustrating a large panel according the second embodiment, shown generally toward an inside surface thereof.
Figure 8B:
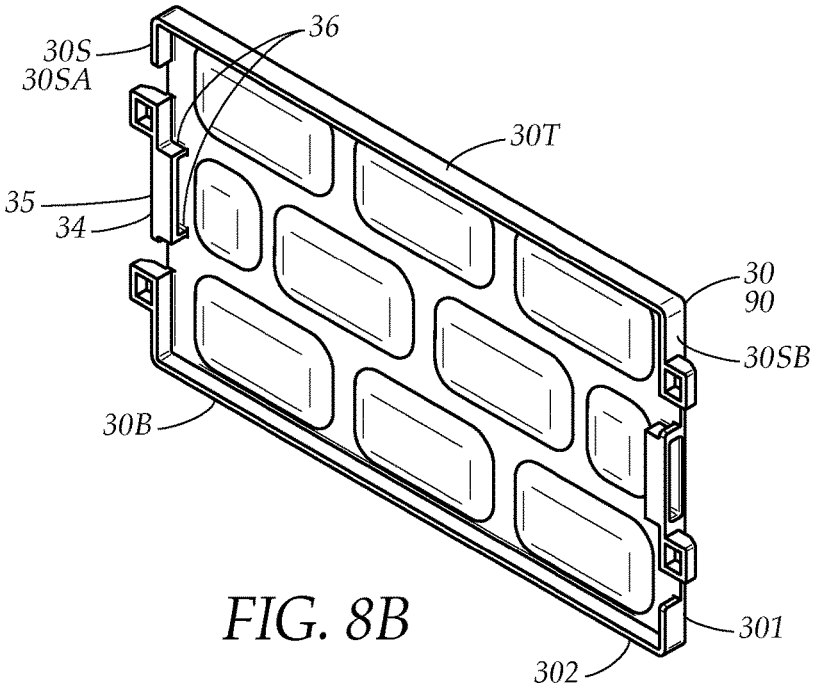
FIG. 8B is a diagrammatic perspective view, illustrating the large panel of the second embodiment, shown generally toward an outside surface thereof.

Referring to FIG. 7, a second embodiment of the adjustable sand mold 10 is illustrated. Like the embodiment of FIG. 1, the second embodiment of FIG. 7 has a main belt 20 and a plurality of panels 30. Each panel 30 has a top edge 30T, a bottom edge 30B, and a pair of lateral sides 30S. Each panel 30 has a panel length between its lateral sides 30S and a panel height between the bottom edge 30B and top edge 30T. Each panel 30 also has an inside surface 301, and an outside surface 302. Each panel 30 has a pair of connecting brackets 34. Referring to FIGS. 8A and 8B, each of the connecting brackets 34 extends generally near and parallel to one of the lateral sides 30S, and typically perpendicular to the top edge 30T and bottom edge 30B. In the second embodiment, however, each of the connecting brackets 34 is at one of the lateral sides 30S and extends between the inside surface 301 and the outside surface 302. In particular, each connecting bracket 34 has a main leg 35 that is substantially coincident with the outside surface 302, and a pair of short legs 36 that join the main leg 35 to the inside surface 301. Each connecting bracket 34 has a belt opening that extends between the inside surface 301 and the main leg 35. Accordingly, as seen in FIG. 7, the belt 20 extends transversely through each panel 30, substantially midway between the inside surface 301 and outside surface 302.

Figure 9A:
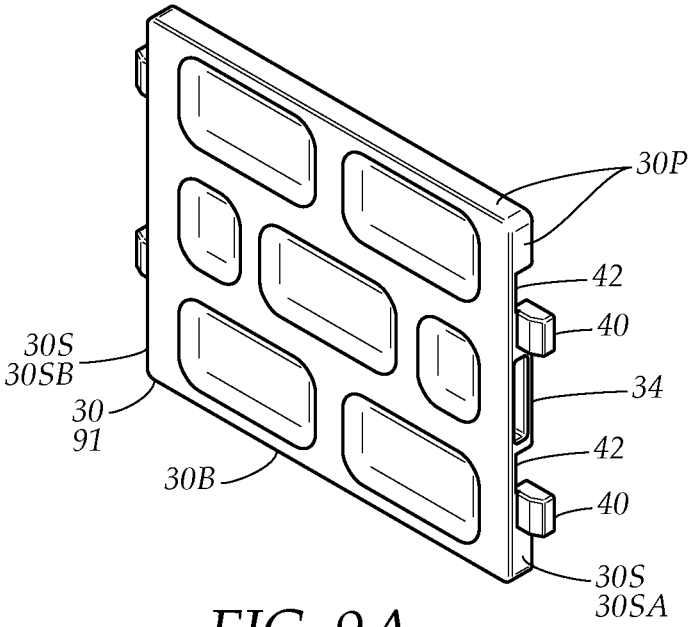
FIG. 9A is a diagrammatic perspective view, illustrating a medium panel according the second embodiment, shown generally toward an inside surface thereof.
Figure 9B:
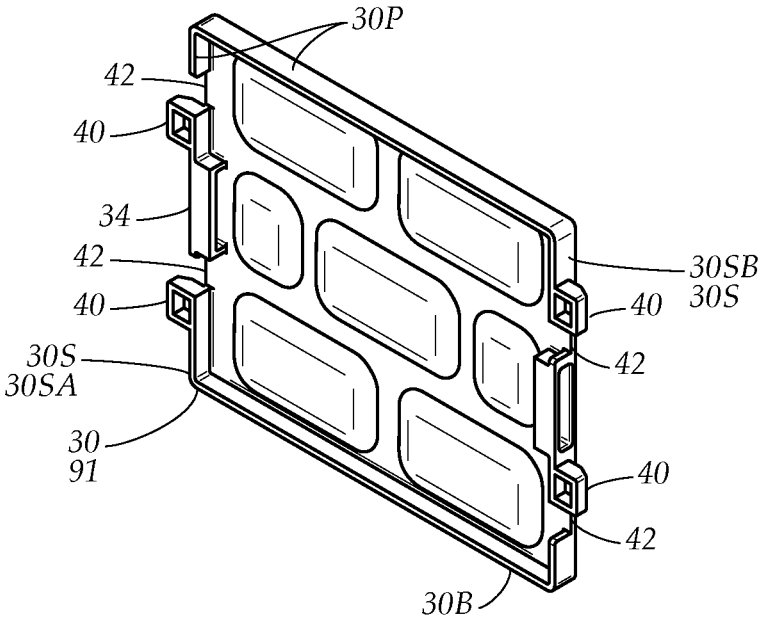
FIG. 9B is a diagrammatic perspective view, illustrating the medium panel of the second embodiment, shown generally toward an outside surface thereof.
Figure 10A:
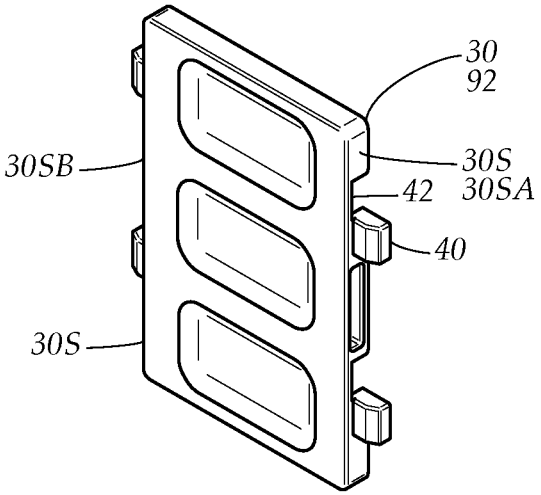
FIG. 10A is a diagrammatic perspective view, illustrating a small panel according the second embodiment, shown generally toward an inside surface thereof.
Figure 10B:
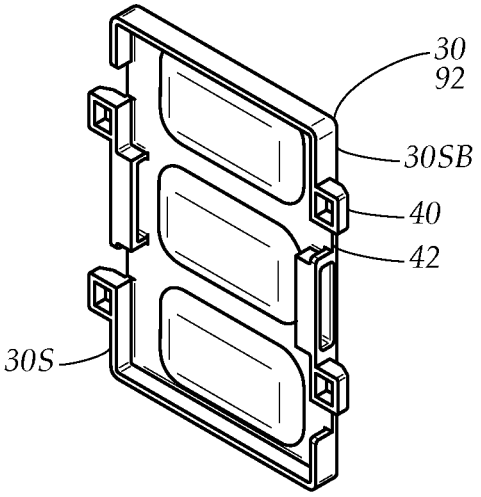
FIG. 10B is a diagrammatic perspective view, illustrating the small panel of the second embodiment, shown generally toward an outside surface thereof.

In this embodiment each panel 30 is substantially hollow between the inside surface 301 and the outside surface 302. Referring to FIGS. 9A and 9B, each panel has a perimeter wall 30P that may be essentially a lip or flange that extends substantially between the inside surface 301 and outside surface 302. The perimeter 30P is substantially uninterrupted on the top edge 30T and bottom edge 30B—extending fully between the inside surface 301 and outside surface—and extends partially onto the lateral sides 30S where the perimeter wall 30P is interrupted by tabs 40 and tab openings 42, and the connecting bracket 34.

Figure 12:
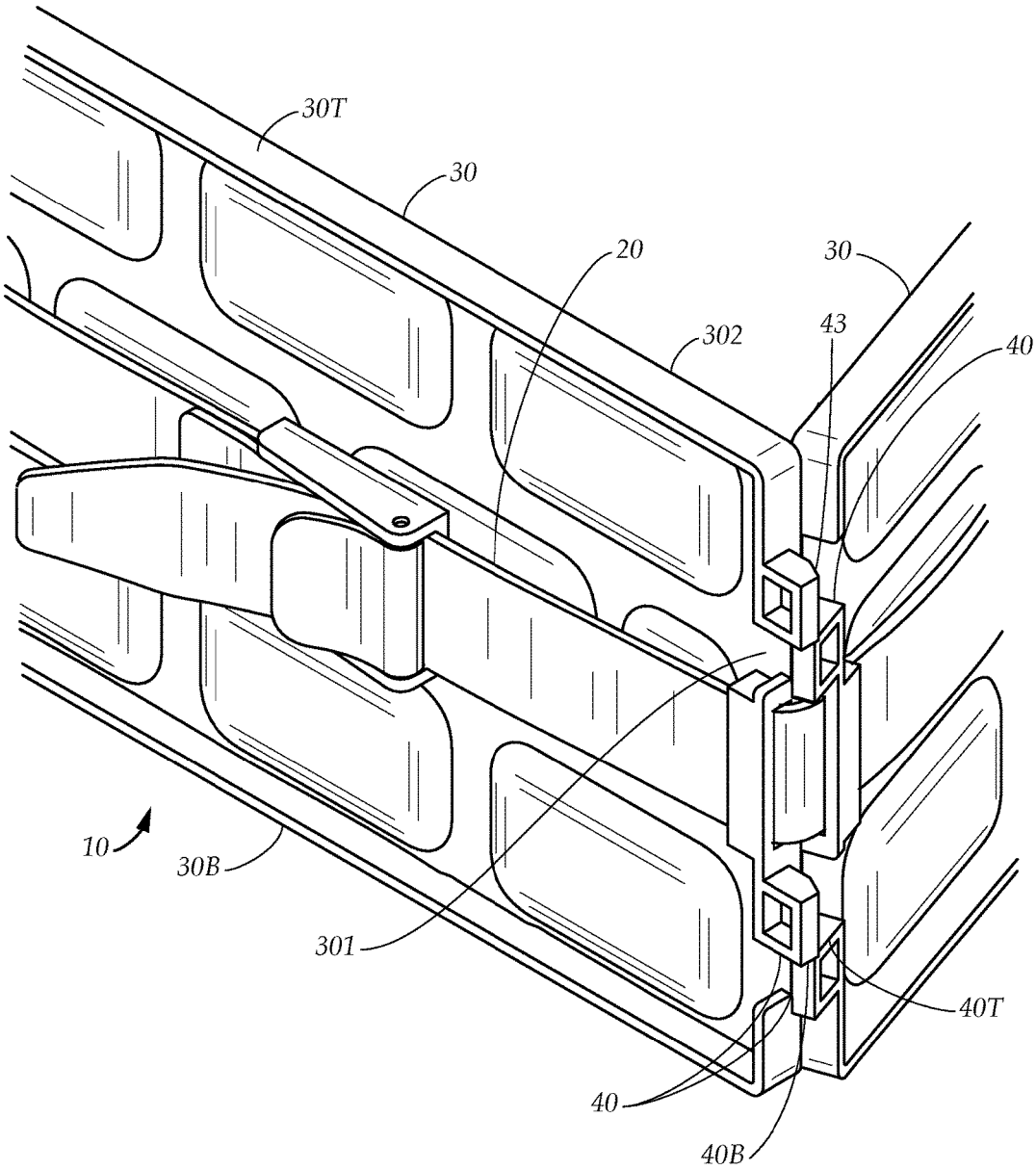
FIG. 12 is an enlarged perspective view, illustrating two adjacent panels held together by the belt.

The tabs extend longitudinally from the lateral sides 30S. The lateral sides 30S include a first lateral side 30SA and a second lateral side 30SB. Each connecting bracket 34 is bordered on one side (either above or below) by a tab 40 and on the other side by a tab opening 42. The tabs 40 and tab openings 42 are rectangular and are substantially the same height. The tabs 40 are correlated with the tab openings 42 so that tabs 40 from one of the panels 30 will correspond with the tab opening 42 from an adjacent panel so that they vertically stack. Accordingly, the tabs 40 have and are located at a tab height, which may be considered the distance they are located along their lateral side 30S from the bottom edge 30B. The openings 42 have and are located at opening height, which is the distance they are located along their lateral side 30S from the bottom edge 30B. Thus, on the first lateral side 30SA the tabs 40 have a tab height that is equivalent to the opening height of the openings 42 on the second lateral side 30SB. Similarly, the tabs 40 on the second lateral side 30SB have a tab height that is equivalent to the opening height of the openings 42 on the first lateral side 30SA. Thus, the tab height and location height are different, and in fact opposite between the first lateral side 30SA and second lateral side 30SB Referring to FIG. 12, the tabs 40 of adjacent panels 30 interact with each other to prevent the panels 30 from twisting transversely (around the belt 20) as the mold is filled with wet sand. This is especially helpful when many panels are used, such that the angle between panels is greater than 150 degrees. Note that the panels 30 illustrated in FIG. 12 are at an acute angle, and the tabs 40 are less critical. Each tab 40 has a tab top 40T and a tab bottom 40B and extends nearly fully between the inside surface 301 and outside surface 302. The tab top 40T and tab bottom 40B of vertically adjacent tabs interact. Note that to some extent, the twisting is prevented by the vertical stacking of the tabs 40, where the tabs 40 of adjacent panels press against each other, and also by the tab 40 of one panel interacting with the inside surface 301 of the adjacent panel 40 at the tab opening 42. To aid this interaction, each tab may have a tab bevel 43, extending vertically between the tab top 40T and tab bottom 40B. The tab bevel 43 provides a small flat surface for interacting with the inside surface 301 of an adjacent panel when the panels are at an angle of approximately 150 degrees.

Figure 11:
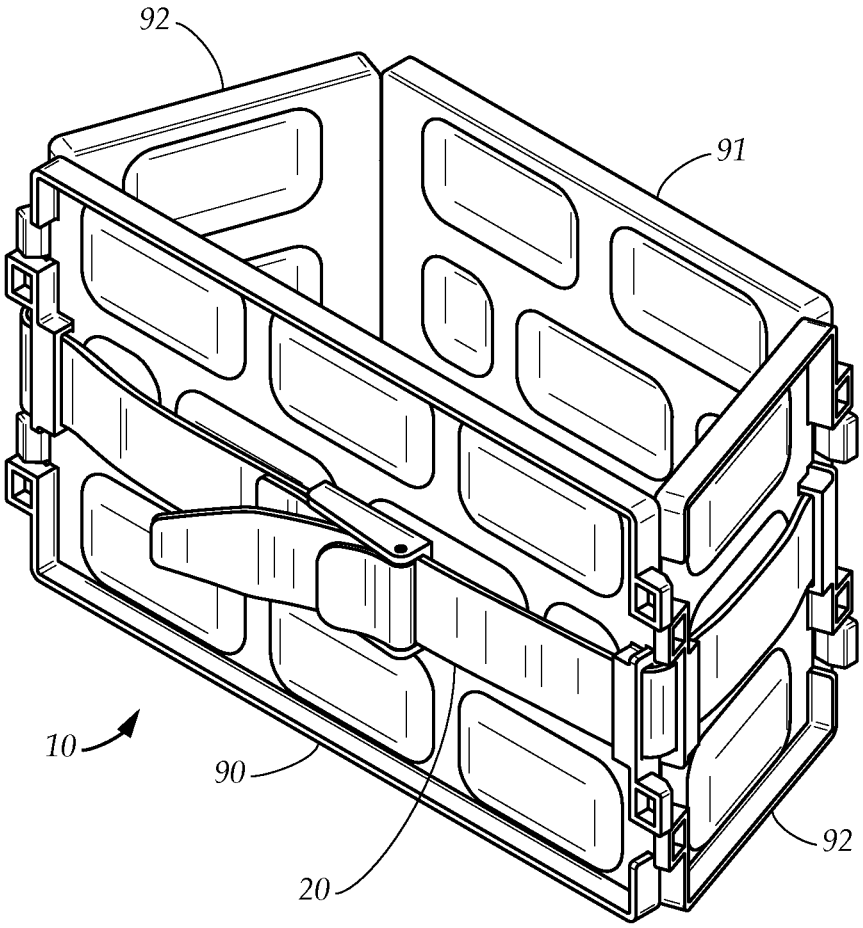
FIG. 11 is a diagrammatic perspective view, illustrating an exemplative sand mold in its closed position, formed in the shape of a square prism.

The panels 30 are provided in different lengths, as measured along the top edge 30T or bottom edge 30B. FIGS. 8A and 8B, FIGS. 9A and 9B, and FIGS. 10A and 10B show different length panels 30, namely a large panel 90 in FIGS. 8A and 8B; a medium sized panel 91 in FIGS. 9A and 9B; and a small sized panel 92 in FIGS. 10A and 10B. All panels preferably have the same height, as measured along the lateral sides 30S. Regardless of their length, all panels preferably have the same tab 40 and tab opening 42 arrangement on the first lateral side 30SA, and have the same tab 40 and tab opening 42 arrangement on the second lateral side 30SB. Accordingly, the panels can be interchanged and used in various combinations. They can be removed from the belt 20, or the belt removed from them, rearranged and substituted, and then the belt 20 can be threaded through the connecting brackets of adjacent panels. For example, in FIG. 11, a large panel 90 is used in conjunction with a medium panel 91, and two small panels 92. Once the belt 20 binds them together, the angles between the panels automatically adjusts.

Figure 13:
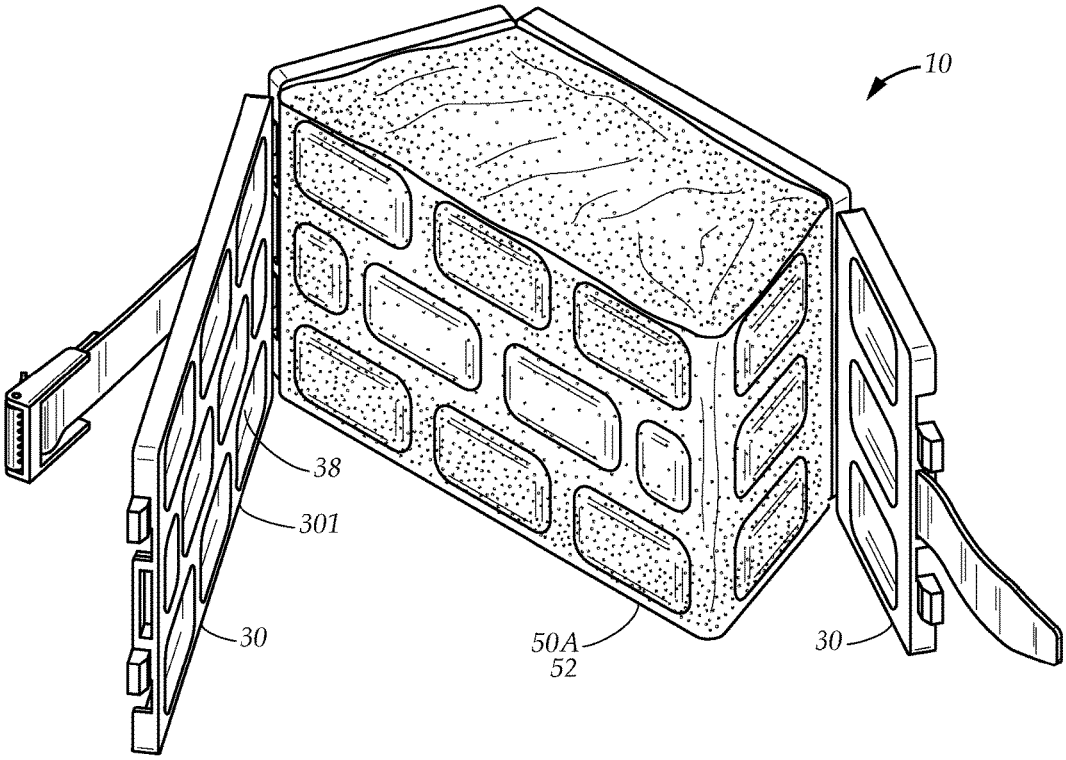
FIG. 13 is a diagrammatic perspective view, illustrating the sand mold being released to reveal a textured sand mound formed thereby.

Referring to FIG. 13, once the desired consistency/mixture of wet sand 50A densely fills all corners and cavities of the mold 10, and the wet sand 50A is leveled within the mold 10 as desired, the mold 10 is released to reveal a sand mound 52 in the shape of the interior cavity 11 as defined by the shape of the mold 10 (as defined by the panels that form the perimeter thereof). To release the sand mound 52 from the mold 10, the belt 20 is loosened and the panels 30 pivoted outwardly to free them from the wet sand 50A. The inside surface 301 of one, some, or all of the panels may have a textured pattern 38 thereon. Illustrated in FIG. 13, the panels have a textured pattern on the inside surface 38 that provides the appearance of a stone wall. The textured pattern provided by the panels 30 can of course be varied in numerous ways, and may be smooth if desired.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented an adjustable sand molding toy. The disclosure is illustrated by example in the drawing figures, and throughout the written description. It should be understood that numerous variations are possible, while adhering to the inventive concept. Such variations are contemplated as being a part of the present disclosure.

What is claimed is:

1. A sand mold toy, for use in forming a shaped sand mound on a ground surface using wet sand, comprising:

a plurality of panels, each panel substantially rectangular, having an inside surface, an outside surface, a bottom edge, a top edge, and a pair of lateral sides comprising a first lateral side and a second lateral side, each panel having a connecting bracket attached to the outside surface of each panel proximate to each of the first lateral side and the second lateral side and substantially midway between the top edge and the bottom edge, each connecting bracket having a main leg that is coincident with the outside surface, a pair of short legs that connect the main leg with the inside surface, each panel has a panel length as defined along the bottom edge, and wherein the panels include at least two panels that have different panel lengths; and a belt, the belt comprising a first end and a second end, the first end extending between the main leg of each connecting bracket and the inside surface of each panel, the belt further comprising a second end and a fastening mechanism, the first end is attached near the second end via the fastening mechanism, the belt selectively tightening the panels against each other with the lateral sides of adjacent panels abutting each other, to form the panels into a polygon with the inside surfaces of the panels facing each other, the belt further forming a flexible hinge between the lateral sides of adjacent panels allowing the angles between the panels of the polygon to be adjusted, and the polygon is adapted to be positioned with the bottom edge upon the ground surface and filled with wet sand to form a shaped sand mound.

2. The sand mold as recited in claim 1, wherein each lateral side of each panel has at least one rectangular tab and at least one rectangular tab opening, the tab is located at a tab height from the bottom edge and the opening is located at a tab opening height from the bottom edge, for every panel the tab height on the first lateral side is equal to the tab opening height on the second lateral side and the tab height on the second lateral side is equal to the tab opening height on the first lateral side, the tab further has a tab top, a tab side, and a tab bottom, the tab side abutting against the inside surface of the adjacent panel, the tab top and tab bottom of tabs from adjacent panels abutting each other and vertically stacking when the belt is tightened.

3. The sand mold as recited in claim 2, wherein each lateral side has two tabs and two tab openings, and wherein each connecting bracket is bordered on one side by one of the tabs and on another side by one of the tab openings.

4. The sand mold as recited in claim 3, wherein each panel has a perimeter wall, the perimeter wall forming a lip that extends between the inside surface and outside surface fully along the top edge and bottom edge, and extends partially onto the lateral sides but is interrupted by the tab openings, and wherein each tab has a tab bevel extending vertically between its tab top and tab bottom, the tab bevel abutting against the inside surface of the adjacent panel when the panel is oriented at an angle of approximately 150 degrees in relation to the adjacent panel.

5. A sand mold toy, for use in forming a shaped sand mound on a ground surface using wet sand, comprising:

a plurality of panels, each panel substantially rectangular, having an inside surface, an outside surface, a bottom edge, a top edge, and a pair of lateral sides, each panel having a connecting bracket at each of the lateral sides of said panel, each connecting bracket has a main leg that is coincident with the outside surface, a pair of short legs that connect the main leg with the inside surface, and a belt opening that extends between the inside surface and the main leg and through the lateral side, at least one of the panels has a textured pattern on the inside surface; and a belt, extending through the belt opening of the connecting brackets of each panel substantially midway between the inside surface and outside surface, for selectively tightening the panels against each other with the lateral sides of adjacent panels abutting each other, to form the panels into a polygon with the inside surfaces of the panels facing each other, the belt further forming a flexible hinge between the lateral sides of adjacent panels allowing the angles between the panels of the polygon to be adjusted, and the polygon is adapted to be positioned with the bottom edge upon the ground surface and filled with wet sand to form a shaped sand mound.

6. The sand mold toy as recited in claim 5, wherein the lateral sides of each panel include a first lateral side and a second lateral side, at each lateral side each panel at least one rectangular tab and at least one rectangular tab opening, the tab is located at a tab height from the bottom edge and the opening is located at a tab opening height from the bottom edge, for every panel the tab height on the first lateral side is equal to the tab opening height on the second lateral side and the tab height on the second lateral side is equal to the tab opening height on the first lateral side, wherein each connecting bracket is bordered on one side by one of the tabs and on another side by one of the tab openings, and wherein each tab has a tab top, a tab side, and a tab bottom, the tab side abutting against the inside surface of the adjacent panel, the tab top and tab bottom of tabs from adjacent panels abutting each other and vertically stacking when the belt is tightened.

7. The sand mold toy as recited in claim 6, wherein the belt has a first end, a second end, and a fastening mechanism for selectively joining the belt into a closed loop in a secured position, wherein the first end is attached near the second end.

8. The sand mold toy as recited in claim 7, wherein each lateral side has two tabs and two tab openings, wherein each panel further has a perimeter wall, the perimeter wall forming a lip that extends between the inside surface and outside surface fully along the top edge and bottom edge, and extends partially onto the lateral sides but is interrupted by the tab openings.

9. The sand mold toy as recited in claim 8, wherein each panel has a panel length as defined along the bottom edge, and wherein the panels include at least two panels that have different panel lengths.

10. A sand molding method, using a sand mold toy having a plurality of panels and a belt having a first end and a second end, each panel having an inside surface and an outside surface, a pair of lateral sides, a top edge, a bottom edge, and a pair of connecting brackets extending perpendicular to the bottom edge, to form a sand mound upon a ground surface, comprising the steps of:

arranging the panels side by side;

threading the first end of the belt through the connecting brackets of adjacent panels;

forming the panels into a polygon with the inside surfaces of the panels facing each other by abutting the lateral sides of adjacent panels by tightening the belt, the belt further forming a flexible hinge between the lateral sides of adjacent panels allowing the angles between the panels of the polygon to be adjusted;

placing the bottom edges of the panels upon the ground surface;

forming the sand mound by filling the sand mold with wet sand; and revealing the sand mound by releasing the belt and pivoting the panels away from the sand mound.

11. The sand molding method as recited in claim 10, wherein each connecting bracket for each panel is located along one of the lateral edges, having a main leg that corresponds with the outside surface and a pair of short legs that connect the main leg with the inside surface, and wherein the step of threading the belt through the connecting brackets further comprises extending the belt through each panel midway between the inside surface and outside surface.

12. The sand molding method as recited in claim 11, wherein the lateral sides include a first lateral side and a second lateral side, at each lateral side each panel at least one rectangular tab and at least one rectangular tab opening, the tab is located at a tab height from the bottom edge and the opening is located at a tab opening height from the bottom edge, for every panel the tab height on the first lateral side is equal to the tab opening height on the second lateral side and the tab height on the second lateral side is equal to the tab opening height on the first lateral side, the tab having a tab top, a tab side, and a tab bottom, and wherein the step of abutting the lateral sides of adjacent panels further comprises preventing the panels from twisting by vertically stacking the tabs by extending the tab from each lateral side into the tab opening of the lateral side of the adjacent panel and abutting the tab top of the tab from each lateral side against the tab bottom of the tab from the adjacent panel, and abutting the tab side of the tab of each lateral side against the inside surface of the adjacent panel.

13. The sand molding method as recited in claim 12, wherein at least one of the panels has a textured pattern on the inside surface of said panel, and wherein the step of forming the sand mound further comprises creating a texture upon the sand mound.

* * * * *